United States Patent [19]

Kankkunen

[11] Patent Number: 4,674,971

[45] Date of Patent: Jun. 23, 1987

[54] CONCRETE SLAB EXTRUDER WITH SHEAR-ACTION CORING MEMBERS

[75] Inventor: Heikki I. Kankkunen, Forssa, Finland

[73] Assignee: Rakennusvalmiste Oy, Forssa, Finland

[21] Appl. No.: 773,534

[22] Filed: Sep. 9, 1985

[30] Foreign Application Priority Data

Sep. 10, 1984 [FI] Finland ..... 843544

[51] Int. Cl.[4] ..... B28B 21/52

[52] U.S. Cl. ..... 425/381; 425/447; 425/456; 425/457

[58] Field of Search ..... 425/466, 380, 381, 378 R, 425/62, 63, 432, 431, 457, 469, 447, 456

[56] References Cited

U.S. PATENT DOCUMENTS

| | | | |
|---|---|---|---|
| 2,748,442 | 6/1956 | Butcher | 425/380 |
| 3,143,781 | 8/1964 | Kalns | 425/432 |
| 3,159,897 | 12/1964 | Ellis et al. | 425/432 |
| 3,176,494 | 4/1965 | Cullen et al. | 425/381 |
| 3,205,534 | 9/1965 | Langecker | 425/466 |
| 3,209,404 | 10/1965 | Hagen | 425/466 |
| 3,877,860 | 4/1975 | Putti | 425/380 |
| 3,909,183 | 9/1975 | Hsu | 425/466 |
| 3,932,102 | 1/1976 | Rosenbaum | 425/466 |
| 3,989,230 | 11/1976 | Martens | 425/432 |
| 4,022,556 | 5/1977 | Goetjen | 425/432 |
| 4,444,702 | 4/1984 | Thomas et al. | 425/381 |
| 4,547,142 | 10/1985 | Arenhövel et al. | 425/378 R |

*Primary Examiner*—Willard E. Hoag

*Attorney, Agent, or Firm*—Birch, Stewart, Kolasch & Birch

[57] ABSTRACT

An extruder for the fabrication of concrete slabs, especially hollow-cored slabs, movable on a casting bed and incorporating a feed hopper or similar, at least one feeder, especially an auger, for generating internal pressure in the cast concrete, and at least one coring member or similar, for generating the desired slab cross-section.

The extruder in accordance with the invention comprises an assembly of at least two wedged surfaces, of which at least one is fitted in conjunction with the coring member, and the space between the surfaces is continuously changing due to a cyclic longitudinal movement, generating inside the space a compacting shear action in the concrete mix.

8 Claims, 8 Drawing Figures

CONCRETE SLAB EXTRUDER WITH SHEAR-ACTION CORING MEMBERS

The present invention relates to a concrete slab extruder.

In the prior art there exists, e.g., a concrete slab extruder in which the concrete mix is fed via auger flights which force the concrete under pressure to the core-forming section and then through it. The bottom side of the concrete slab cross-section is defined by the form of the casting bed, the other sides being defined by the side and top mold plates of the extruder. The hollow channels in the slab are formed by the coring members which follow the augers. A prior art extruder with coring members between the augers also exists. The compacting of concrete is done with high-frequency vibrators (50 . . . 200 Hz). The vibration is then applied to the coring members, side mold plates or top mold plate, and in some cases to all of these.

This extruder construction is widely used but has, e.g., the following disadvantages: The vibration compaction process generates heavy noise; the vibrating mechanism has a complicated construction and contains several wearing parts; and the concrete compaction is uneven between the thinner and thicker wall sections.

A further prior art construction with the following principle exists: In the first phase of the process, the extruder feeds a layer of concrete onto the casting bed. This forms the base section of the slab shell. In the next phase, another layer of concrete is fed between the coring members of the extruder. The coring member tubes perform a cyclic longitudinal movement to improve the homogenization of the concrete mix. In addition, the tubes are vibrated at a high frequency (50 . . . 200 Hz) to compact the concrete. The extruder then feeds a third layer of concrete over the tubes, and finally a vibrating trowel beam performs the levelling and compaction of the upper surface.

Though the construction described above is widely used, it has, e.g., the following disadvantages: The concrete must be fed in several phases before the mold is sufficiently filled; the machine is not operable with a sufficiently dry concrete mix; and the compacting vibration generates heavy noise.

By means of the method in accordance with this invention, the aim is to overcome the disadvantages found in prior art constructions and to present a completely new type of extruder which is especially applicable for use with stiff concrete mixes.

The extruder according to the invention feeds the concrete by auger flights or other feeding devices into a pressurized space. The coring members and/or surrounding core-forming nozzle parts in the pressurized space are so formed that, by a cyclic longitudinal movement in the entire cross-section of the cast concrete, they generate a shear-action that compacts the concrete mix. To provide the concrete with an unobstructed flow, the movement of the coring member is arranged in the longitudinal direction of the slab. The invention is furthermore characterized in that the concrete compacting is not carried out by conventional vibrating but by shear mixing or "shear compacting". This is generated by the low-frequency, cyclic longitudinal work movement and the wedge-shaped form of the core-forming members.

More specifically, the extruder in accordance with the invention is characterized by what is stated in the characterizing part of claim 1.

The extruder in accordance with the invention is ideally suited for the construction of concrete slabs in a concrete products factory with technology fulfilling modern requirements. The extruder is capable of fabricating hollow-cored slabs or other longitudinally profiled slabs. It is especially applicable for use with stiff concrete mixes and it is characterized by a compaction method that does not generate noise and vibration. In addition, the machine also provides the technological facilities for manufacturing new types of concrete products.

In the following, the invention will be examined in more detail by means of the exemplifying embodiments as applied to a hollow-cored slab extruder, in accordance with the attached drawings. The invention is also applicable as such for the casting of other types of profiled slabs.

Figure 1:
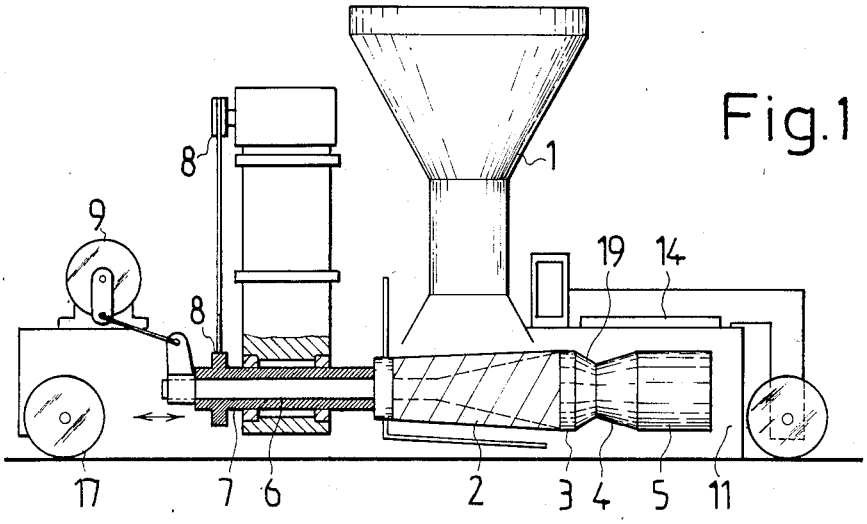
FIG. 1 shows a side view of the extruder in accordance with the invention.

The extruder shown in FIGS. 1 . . . 4 incorporates a concrete feed hopper 1 from which the concrete mix flows into augers 2. The augers 2 ensure an even feed and the required pressure for the concrete mix. As shown in the figure, the augers are located in line with the forming members 5. The extruder can also be implemented by locating the augers 2 between the forming members 5 or in an inclined position for feeding the concrete mix from the top downwards. The extruder can also be implemented by pressure-generating feeders other than augers.

The outlet end of the augers 2 is provided with a seal section 3 which prevents the concrete from penetrating the seam between the rotating auger 2 and the stationary forming member 5. The seal section also prevents the concrete flow in the seam in an embodiment in which the auger 2 remains stationary in the longitudinal direction and the forming member 5 makes the cyclic longitudinal movement. The seal itself can be of any conventional type: a labyrinth seal, resilient rubber seal, lip seal, etc.

Figure 5:
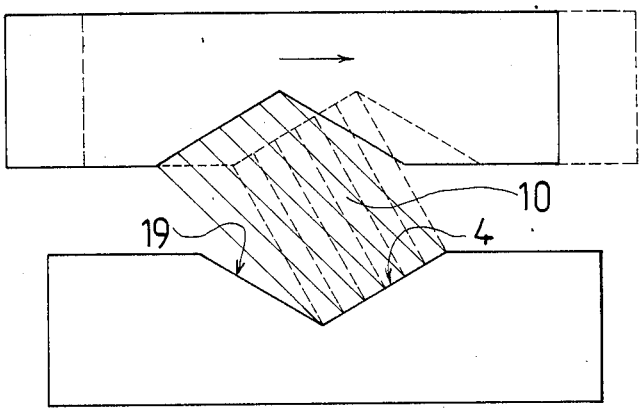
FIG. 5 shows the forming process between two adjacent wedge-shaped forming parts to describe the concrete compaction principle.

Next to the seal 3 and in the direction of the concrete flow is the tapered forming part 4, 19 of the forming member 5 which has such a taper of the cross-section in the longitudinal direction that a space 10, variable by the longitudinal movement of the two adjacent surfaces bordering the concrete mix space, is obtained to generate a shear mixing of the stone aggregates in the concrete. This concrete mixing by wedge surfaces 4, 19 is shown in detail in FIG. 5. When the movement of the forming members 5 is longitudinally cyclic, an internal shear which compacts the concrete is generated in the concrete mix. The depth and length of the wedge surfaces 4, 19 influence the mixing degree, and a less tapered forming member is preferably used for thin sections of the slab.

The most desirable length for each stroke in the longitudinal movement is about 5 . . . 50 mm with a movement frequency of about 1 . . . 10 strokes/s (Hz). Naturally, the suggested reference values can be changed. When desired, the wedge-shaping 4', 19' for the compaction effect can also be made in the side mold plates 11 and the top mold plate 14, which can be provided with a cyclic movement using conventional actuators 13, 15.

Figure 2:
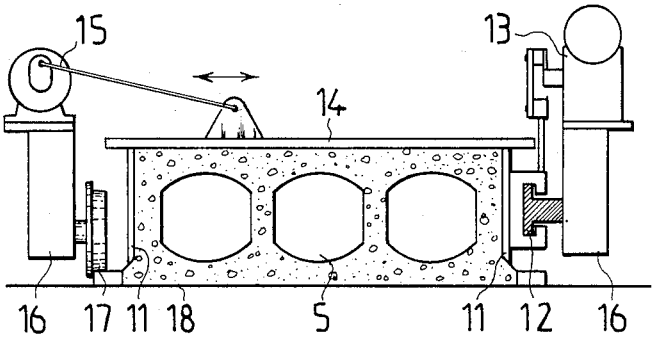
FIG. 2 shows a schematic end view of the extruder for the fabrication of a three-cored slab.
Figure 3:
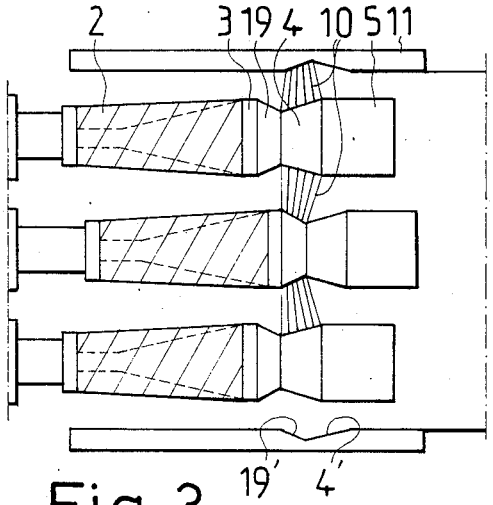
FIG. 3 shows a schematic top view when augers and the forming members are at the extreme position of the cyclic longitudinal movement.
Figure 4:
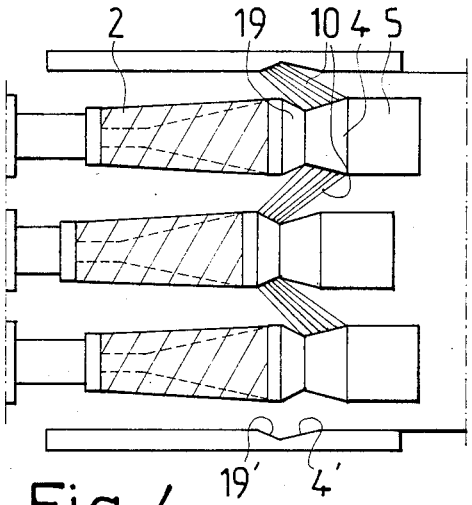
FIG. 4 shows in a top view the other extreme position of the cyclic longitudinal movement.

The taper 5, 19, or core-forming part, is followed by an extension 5 of the coring member which gives the core its final shape. The core shape (a TV screen shape in FIG. 2) can, of course, be any desired shape.

The cyclic longitudinal movement of the coring member 5 and the auger 2 is achieved by an actuator 9 (cam actuator). The guide section 6, 7 permits the longitudinal compaction movement in relation to the chassis and the coring member. The drive of augers 2 is arranged from a drive aggregate 8 by a belt, chain, etc.

The machine can also be implemented so that the auger 2 and the auger drive tube 7 are stationary in the longitudinal direction, and the coring members 5 with their tapers 4, 19 perform the cyclic longitudinal movement, driven by the guide bar 6 and the drive 9.

Side mold plates 11 form the side profile of the slab. The side mold plates 11 can be provided with wedges 4', 19' to perform the shear compaction. In this case, the side mold plates 11 can be provided with longitudinal movement along a guide 12 by the cam actuator 9 or a separate actuator 13.

The top mold plate 14 forms the upper surface of the slab. The top mold plate can also be provided with shear compaction wedging, or it can operate as a straight trowel plate, e.g., according to FIG. 2, performing a transverse movement and actuated by a drive 15. The machinery is installed in a chassis 16, which moves on carrier wheels 17 over a casting bed 18.

The compaction space 10 is preferably obtained by providing the tapered section of coring member 5 first with a tapering part 19 and then with an expanding part 4, since this arrangement provides an efficient shear compaction in both stroke directions. However, the compaction can also be achieved using one monotonously tapering wedge surface (tapered or inclined surface) and the cyclic longitudinal movement, or, if required, several compaction spaces 10 can be coupled in series. Naturally, the machinery can be complemented in some parts by conventional high-frequency vibration.

Figure 6:
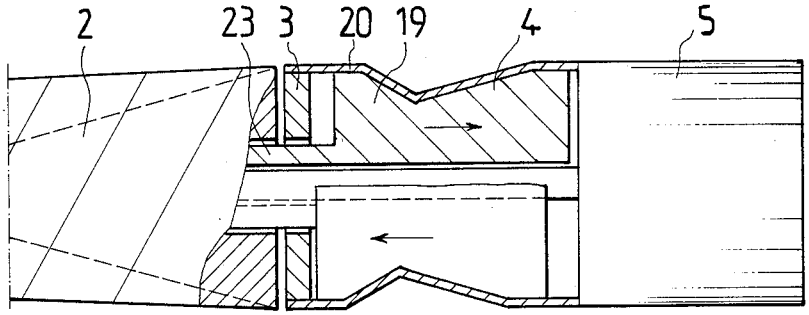
FIG. 6 shows another embodiment of the invention, in which the cyclically-moving forming member is inserted in a flexible hose.

FIG. 6 shows another embodiment in accordance with the invention. In this construction, the cyclically moving wedge part 4 of the coring member is inserted in a flexible hose 20. The rotating auger 2, the seal section 3, the flexible hose 20, and the extension of the coring member 5 are stationary. The upper part of the figure shows in sectional view one extreme position of the wedged part 4, 19, and the lower part shows the other extreme position.

Figure 7:
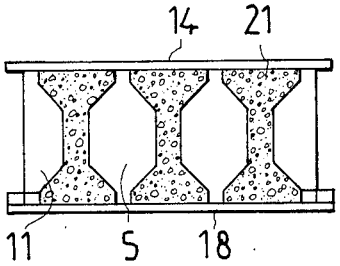
FIGS. 7 and 8 show in sectional views beams and pillars fabricated with an extruder in accordance with the invention.

FIG. 7 shows an embodiment in which the cross-sectional form of the side mold plates and the internal coring members is altered to allow the extruder in accordance with the invention to be used for fabricating concrete beams 21. The beams 21 can be cast as single beams or several in parallel. The embodiment according to the figure is preferably implemented so that the augers feed the concrete into the space between the side mold plates 11 and coring members 5, thus allowing the augers to be located at the upper edge of the beam.

Figure 8:
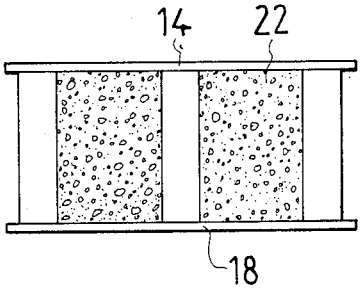

FIG. 8 shows an embodiment in which the cross-sectional form of the side mold plates and the internal coring members is further altered to allow the extruder in accordance with the invention to be used for fabricating concrete pillars 22. The pillars 22 can be cast as single pillars or several in parallel.

What is claimed:

1. An extruder for casting concrete slabs, especially hollow-cored concrete slabs, moving on a casting bed, comprising:

a feed hopper, at least two combinations of an auger and a coring member, each said combination having an axial direction and being positioned between mold plates, each said auger being located to receive concrete from said hopper, each said coring member having an annular groove which forms a wedge surface, adjacent said combinations having a space therebetween, means for cyclically reciprocating said combinations of an auger and a coring member in a parallel relationship in their axial direction such that adjacent combinations are moving in opposite directions at any given time, and said means causes said space between said combinations to continuously change in order to generate a compacting shear action in the concrete in said space.

2. An extruder as claimed in claim 1, in which said means for cyclically reciprocating includes a guide bar connected to each said combination.

3. An extruder as claimed in claim 1, in which each said auger and said coring member are movable by said means as an entity.

4. An extruder as claimed in claim 1, in which said mold plates are each provided with a wedge surface.

5. An extruder as claimed in claim 1, in which said means for cyclically reciprocating is capable of providing a longitudinal movement by a push-pull action.

6. An extruder as claimed in claim 1, in which said wedge surfaces are formed on members which are positioned inside a flexible hose.

7. An extruder as claimed in claim 1, in which said coring member includes a portion having said wedge surfaces attached to the remainder of said coring member.

8. An extruder as claimed in claim 1, in which said means for cyclically reciprocating said combination is capable of producing longitudinal movement having an amplitude of 5 to 50 mm and a frequency of 1 to 10 Hz.

* * * * *

Notice of Adverse Decision in Interference

In Interference No. 101,914, involving Patent No. 4,674,971, H. I. Kankkunen, CONCRETE SLAB EXTRUDER WITH SHEAR-ACTION CORING MEMBERS, final judgment adverse to the patentee was rendered Nov. 23, 1988, as to claims 1 - 8.

[*Official Gazette February 14, 1989.*]